US007100625B2

(12) United States Patent
Valles

(10) Patent No.: US 7,100,625 B2
(45) Date of Patent: Sep. 5, 2006

(54) SCREEN ROOM ENCLOSURE AND METHOD OF ATTACHMENT

(75) Inventor: Fernando Valles, El Paso, TX (US)

(73) Assignee: Dometic Corporation, Elkhart, IN (US)

( * ) Notice: Subject to any disclaimer, the term of this patent is extended or adjusted under 35 U.S.C. 154(b) by 521 days.

(21) Appl. No.: 10/662,672

(22) Filed: Sep. 15, 2003

(65) Prior Publication Data

US 2005/0055964 A1 Mar. 17, 2005

(51) Int. Cl.
*E04H 15/08* (2006.01)
*E04H 15/64* (2006.01)
*E04F 10/06* (2006.01)

(52) U.S. Cl. ..... 135/88.13; 135/88.12; 135/88.15; 135/119; 135/120.3; 296/159; 296/163; 296/160; 296/47

(58) Field of Classification Search ..... 135/88.11, 135/88.12, 88.13, 119, 120.3, 88.15; 296/159, 296/163; 24/580.1, 580.11, DIG. 53, DIG. 54; 411/349, 549, 553; 160/47
See application file for complete search history.

(56) References Cited

U.S. PATENT DOCUMENTS 289,991 A * 12/1883 Curtis ..... 24/580.1
2,287,667 A 6/1942 Brown
2,787,321 A * 4/1957 Dietz ..... 160/47
2,839,165 A * 6/1958 De Gasso ..... 403/22
3,664,434 A * 5/1972 Connor et al. ..... 172/536
3,720,438 A * 3/1973 Johnson et al. ..... 135/88.1
4,061,394 A * 12/1977 Vodin ..... 296/100.16
4,195,877 A * 4/1980 Duda ..... 296/172
4,634,172 A * 1/1987 Duda ..... 296/163
4,706,599 A * 11/1987 Johnson ..... 114/361
4,924,895 A * 5/1990 Bailie ..... 160/67
5,076,748 A * 12/1991 Waterfield et al. ..... 411/551
5,170,811 A * 12/1992 Kirk et al. ..... 135/88.11
5,437,322 A * 8/1995 Murray ..... 160/61
5,549,129 A 8/1996 Beckert
5,718,253 A 2/1998 McNamee
6,145,525 A * 11/2000 Mooney ..... 135/119
2002/0162198 A1 11/2002 Freney

FOREIGN PATENT DOCUMENTS

DE 35 38 287 4/1987
DE 202 16 427 U 1/2003
GB 2 207 893 A * 2/1989

* cited by examiner

*Primary Examiner*—Robert Canfield
(74) *Attorney, Agent, or Firm*—Pearne & Gordon LLP

(57) ABSTRACT

A fastening assembly and method to releasably secure a panel of a novel screen room enclosure to a structure. The fastening assembly includes a clip having a channel portion fastened to a flat portion, the channel portion having an opening adapted to receive an edge of a panel, and, a locking fastener having an elongated locking member adjustable between a first position and a second position. The flat portion of the clip comprises a hole for accepting the locking fastener such that the locking member can pass through the hole when the locking member is in the first position, and cannot pass through the hole when the locking member is in the second position. A screen room enclosure to be used with an awning of a structure and releasably coupled to the structure with a fastening assembly. A method of securing a side panel of the screen room enclosure to the structure with the clip is disclosed.

21 Claims, 3 Drawing Sheets

SCREEN ROOM ENCLOSURE AND METHOD OF ATTACHMENT

BACKGROUND OF THE INVENTION

1. Field of the Invention

The present invention relates generally to shelters, and more particularly to a portable screen room enclosure and a method of attaching same to a wall of a structure.

2. Description of Related Art

Recreational vehicles ("RVs") are becoming an ever more popular alternative for vacationers. They provide many of the same comforts of home in a mobile package that can be relocated to many vacation destinations where permanent lodging is not available. Unlike tents, RVs provide durable shelter that can withstand severe weather conditions and provide security to persons and property therein. However, the dimensions of RVs, and accordingly, the usable area therein is limited to allow them to safely navigate public roads.

To provide a user with more usable space without making the RV too large for public roads, several detachable screen rooms have been developed for use while the RV is deployed at a desired destination. They also enable users to enjoy the outdoors without irritation from pests such as insects and spiders. Such screen rooms are typically comprised of a front panel that hangs from an awning assembly attached to the RV, and two side panels that extend from a side of the RV to the front panel to complete the screen room enclosure. The side panels are sized to extend along the awning at their upper portions, and along the ground at their lower portions. Each side panel must fasten to a side of the front panel at their outer edge and to the side of the RV at their inner edge. To prevent the admission of weather such as rain, and bothersome animals such as insects, the side panels must be attached to the side of the RV such that they form a suitably tight seal against the side of the RV without requiring a significant amount of labor.

Such screen room enclosures are also capable of being attached to structures, other than recreational vehicles, that have a generally vertical wall. Seasonally used cabins do not warrant the costly construction of a permanent screen room adjacent to the existing structure. Alternatively, unique occasions such as a party or gathering of people at a private residence, for example, require more interior gathering space than may be available at the residence. Screen room enclosures provide temporary interior space as needed without significant alterations to the existing structure.

Installing conventional screen room enclosures having locking fasteners is difficult, time consuming, and requires drilling at least two holes in the RV components for the installation of each fastener. After the fasteners are installed on the side of the RV, they cannot be easily removed. Typically, they must be unscrewed from the RV and the remaining holes must be filled with a sealing compound. When the fasteners are removed, the large number of holes left behind in the side of the RV weaken the integrity of the side wall and create an unpleasant appearance.

Methods of installing conventional screen room enclosures require the location of the installed fasteners to precisely correspond to the position of compatible fastening features on the side panels. These precise measurements accordingly increase the time required to carefully identify the appropriate location for installing the fasteners. An error in making such a determination will require drilling even more holes into the side of the RV to properly install the fasteners and correct the error. Further, obstructions, such as windows or wheel wells, for example, may be present at the locations on the RV corresponding to the position of the fastening features of the side panels, thus, interfering with the installation of the fasteners at those locations. Additionally, side panels that are fastened to the side of the RV periodically along the inner portion of the side panels may not form a suitably tight seal with the side of the RV to prevent the elements or animals from entering the screen room.

Alternative methods of fastening side panels to the side of an existing structure have been developed to overcome the aforementioned shortcomings of using conventional fasteners. These alternatives include the use of fasteners secured to the existing structure by an adhesive. The adhesively secured fasteners must have a sufficiently large surface area in contact with the side of the existing structure to withstand the forces the screen room will be subjected to due to wind, rain and the like, and remain attached to existing structure. The large adhesively secured fasteners create an unpleasant appearance when installed on the side of the structure. Additionally, the use of an adhesive to secure the fasteners to the structure requires a time consuming cleaning process before installing the fasteners. Structures treated with a coating such as a polymer sealant or protectant, for example, also require a user to follow special cleaning procedures that may include expensive cleaning agents. And existing structures constructed from materials that do not offer sufficient bonding surfaces prevent the use of this type of fastener. Furthermore, if the user desires to alter the dimensions of the screen room after installation of the adhesively secured fasteners, a second set of fasteners must be purchased and installed according to the dimensions of the new screen room.

Thus, there exists a need for a screen room enclosure for existing structures that is portable and simple to install and erect. The enclosure provides privacy and a degree of isolation from weather and pests. The enclosure also minimizes the amount of labor and the number of permanent alterations of the existing structure required for installation, while providing flexibility for the location of fasteners on the side of the existing structure. Once the enclosure is installed, it provides a user the option of enclosing the space adjacent the existing structure within the wall of the existing structure, the awning, and the enclosure to create an additional room.

SUMMARY OF THE INVENTION

The present invention is directed toward a fastening assembly to releasably secure a panel to a structure. The fastening assembly includes a clip having a channel portion fastened to a flat portion, the channel portion having an opening adapted to receive an edge of a panel, and the flat portion having a hole, and a locking fastener having an elongated locking member adjustable between a first position and a second position. The locking member can pass through the hole when the locking member is in the first position, and cannot pass through the hole when the locking member is in the second position.

Also included within the scope of the present invention is a screen room enclosure to be used with an awning of a structure, the awning being coupled to a wall of the structure. The screen room enclosure includes a locking fastener for installation at the wall of the structure, a side panel having a first edge to be located adjacent to the structure when the screen room enclosure is erected, and a clip to couple the side panel to the locking fastener, the clip being slidable along the first edge relative to the side panel.

Further, a method of securing a side panel of a screen room enclosure to a structure, wherein the side panel comprises a first edge, is disclosed. The method includes the steps of installing a locking fastener at a location on a wall of the structure, the location being free of obstructions, attaching a clip to the first edge and moving the clip relative to the first edge such that the location of the clip on the first edge generally corresponds to the location of the installed locking fastener on the structure, and coupling the first edge to the structure by securing the clip to the structure with the locking fastener.

DETAILED DESCRIPTION OF THE EMBODIMENTS OF THE INVENTION

Figure 1:
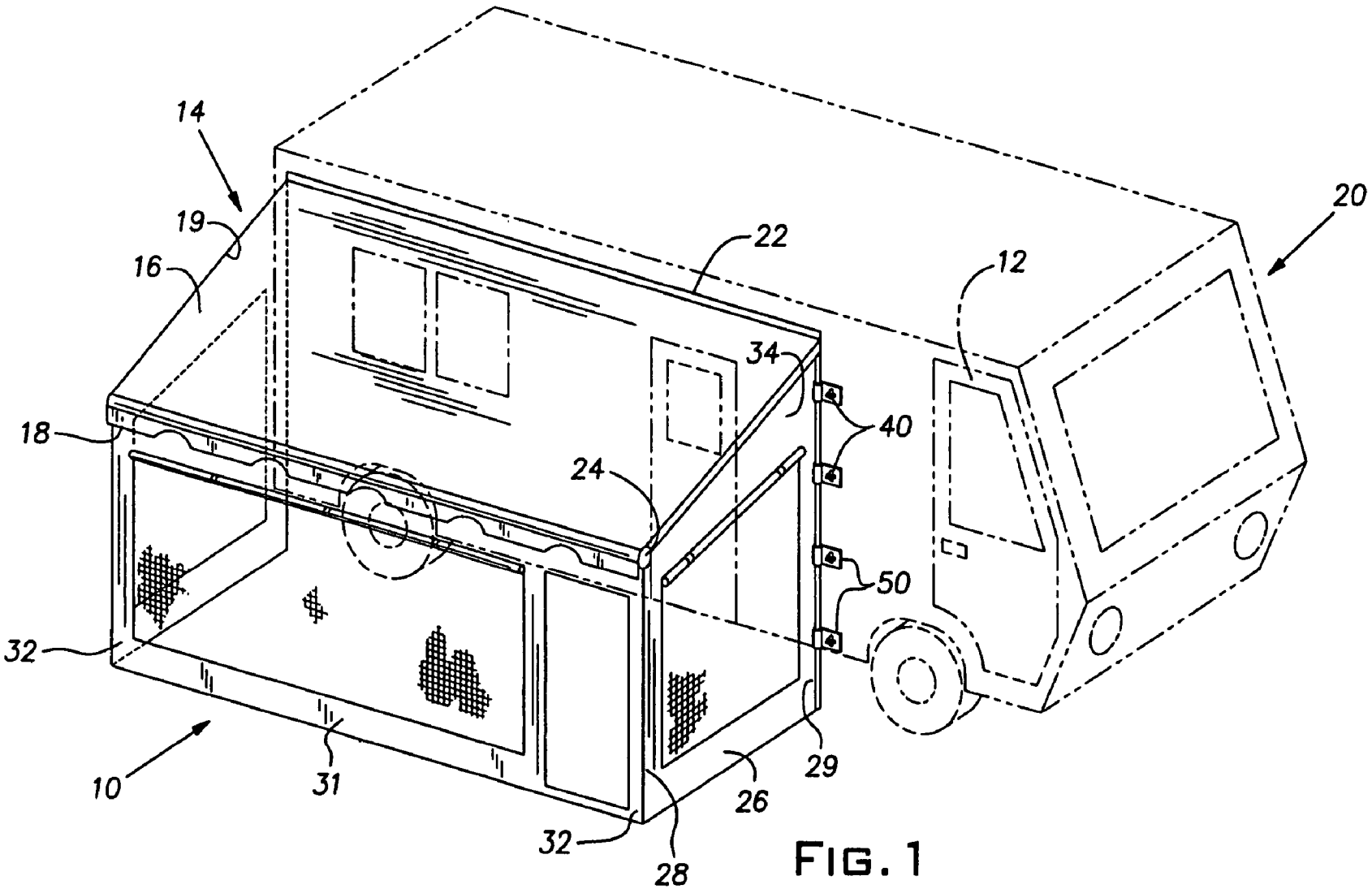
FIG. 1 is a perspective view of an awning and a screen room enclosure attached to a recreational vehicle according to the present invention, the awning and recreational vehicle being shown in phantom.

Certain terminology is used herein for convenience only and is not to be taken as a limitation on the present invention. For example, the present invention is described in detail below with reference to its use with a recreational vehicle. However, the scope of the invention includes a screen room enclosure compatible with any structure having a generally vertical wall sheltered by an awning. Further, in the drawings, the same reference numerals are employed for designating the same elements throughout the figures, and in order to clearly and concisely illustrate the present invention, certain features may be shown in somewhat schematic form.

Referring to FIG. 1, a structure, such as a recreational vehicle ("RV") 20, has a generally vertical side wall 12. When erected, a screen room enclosure 10 is typically attached to a deployed awning assembly 14 mounted at a suitable height on the side wall 12. The awning assembly includes an awning 16 having a distal edge 18, side edges 19, and a proximate edge 22. The awning 16 is rollable on a movable roller tube 24 that is secured to the distal edge 18 of the awning 16. The proximate edge 22 of the awning 16 is secured to the wall of the RV 20 at the suitable height.

The screen room enclosure 10 includes side panels 26 having an outer edge 28 and an inner edge 29, and a front panel 31. Releasable fasteners (not shown) are disposed on the outer edge 28 of the side panels 26 to engage compatible fasteners (not shown) disposed on opposite sides of the front panel 31, thereby releasably securing the side panels 26 to the sides 32 of the front panel 31. Suitable releasable fasteners for this application include items such as zippers, hook and loop fastener material marketed under the trade name Velcro, snaps, tie straps, or clips, for example. The side panels 26 secured to the front panel 31 form the three external walls of the screen room enclosure 10.

A top edge 34 of the side panels 26 is adapted to be removably secured to the side edges 19 of the awning 16 while the screen room enclosure 10 is erected. Securing the top edge 34 of the side panels 26 to the side edges 19 of the awning 16 may be accomplished through the use of releasable fasteners similar to those used to secure the outer edge 28 of the side panels 26 to the sides 32 of the front panel 31, or through the use of an alternative securing method such as a welt (not shown) that is compatible with a channel (not shown) disposed at the side edges 19 of the awning. As described to this point, the screen room enclosure is conventional and represents merely an example of a screen room enclosure that can be secured to the RV according to the present invention.

Figure 3:
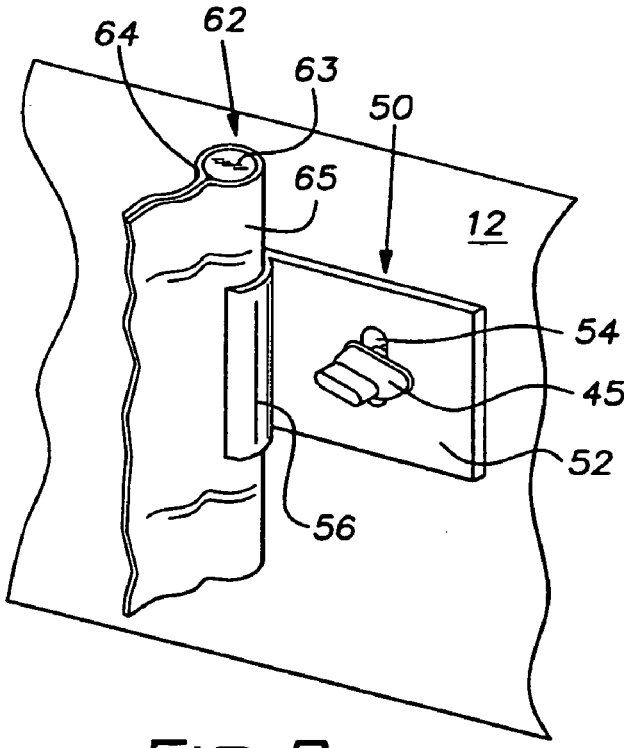
FIG. 3 is a perspective view of an assembled portion of the side wall attachment apparatus according to the present invention with the locking member in a second position.
Figure 4:
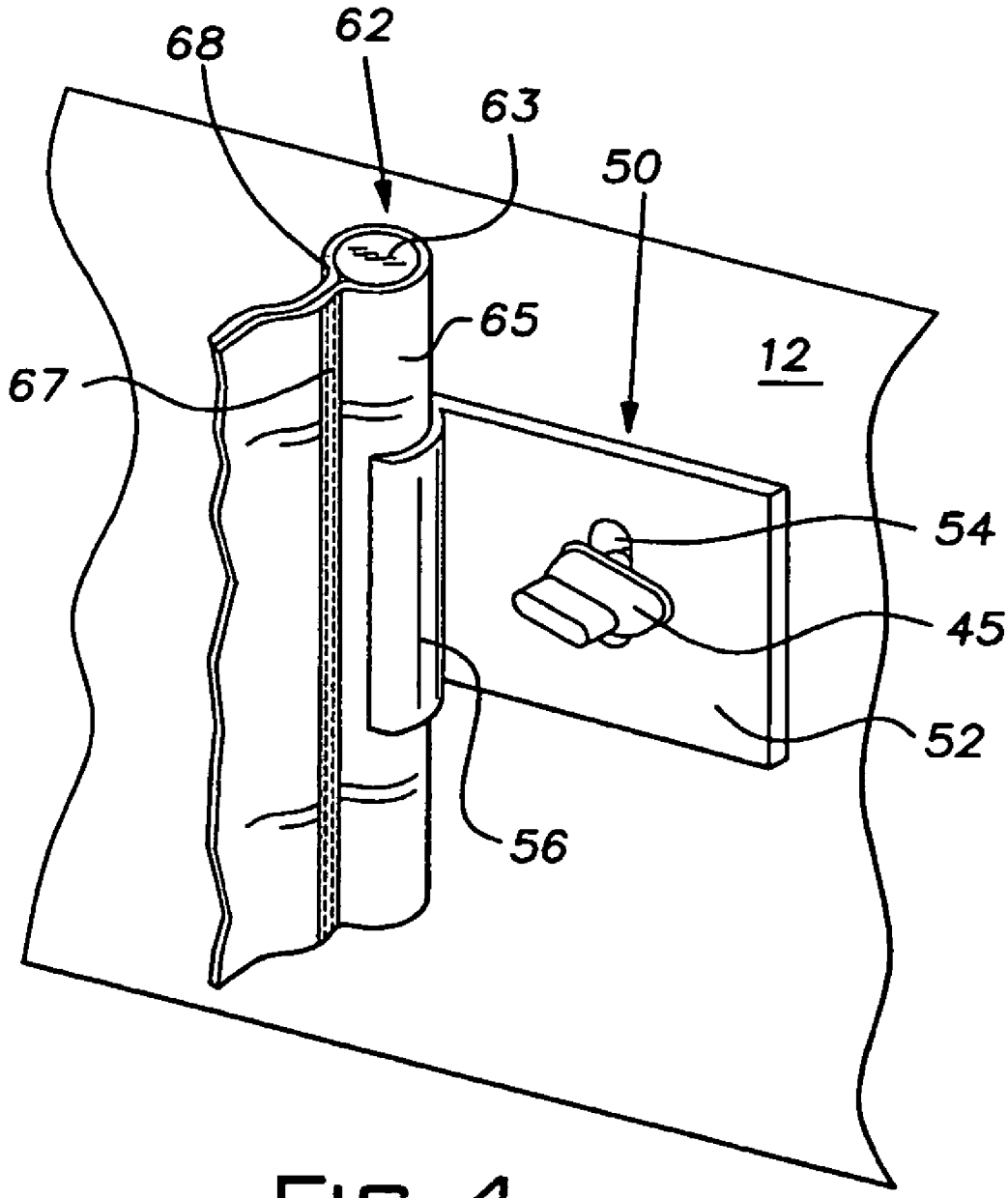
FIG. 4 is a perspective view of another assembled portion of the side wall attachment apparatus according to the present invention with the locking member in a second position.

FIG. 1 further illustrates a screen room enclosure 10 attached to the wall 12 of the RV 20 according to the present invention. A locking fastener 40, as shown in FIGS. 3 and 4, projects from a hole 43 drilled into the surface of the side wall 12. The locking fastener 40 is comprised of an elongated locking member 45 rotatably connected to a fastening member 47 having a central axis 41. The locking member 45 is connected to the fastening member 47 such that the locking member 45 is generally perpendicular to, and rotatable about the central axis 41. A leading edge of the fastening member 47 is threaded for engaging the inner periphery of the hole 43, thereby securing the locking fastener 40 to the side wall 12. Although the locking member 45 has been described herein as an elongated member, other suitably shaped locking members such as oblong, rectangular, or curve shaped members, for example, are included within the scope of the present invention. The locking member 45 may be of any shape that is capable providing a locking force to secure the side panels 26 to the RV 20 as described in detail below.

A channel clip 50 adapted to communicate with the locking fastener 40 described above is comprised of a flat portion 52 defining a locking hole 54, and a channel portion 56 fastened to the flat portion 52. The flat portion 52 is a generally flat geometric shaped sheet of durable material having dimensions that are sufficiently large to support the channel portion 56 and encompass the locking hole 54. When the channel clip 50 is installed on the wall 12 of the RV 20, the flat portion 52 is located adjacent to, and generally parallel to the wall 12, while the channel portion 56 is oriented such that a restricted opening 55 in the channel portion is directed outwardly from the wall 12.

Holding the channel clip 50 in place at the wall 12 of the RV 20 is the locking fastener 40, which engages the flat portion 52 adjacent to the locking hole 54. The shape of the locking hole 54 is compatible with the shape of the locking member 45 such that the locking member 45 can pass through the locking hole 54 when the locking member 45 is in a first position and may not pass through the locking hole 54 when the locking member 45 is in a second position. According to one embodiment of the present invention, illustrated in FIGS. 3 and 4, the locking hole 54 is a generally vertical oval shaped hole such that it is compatible with the elongated locking member 45 described above.

Figure 2:
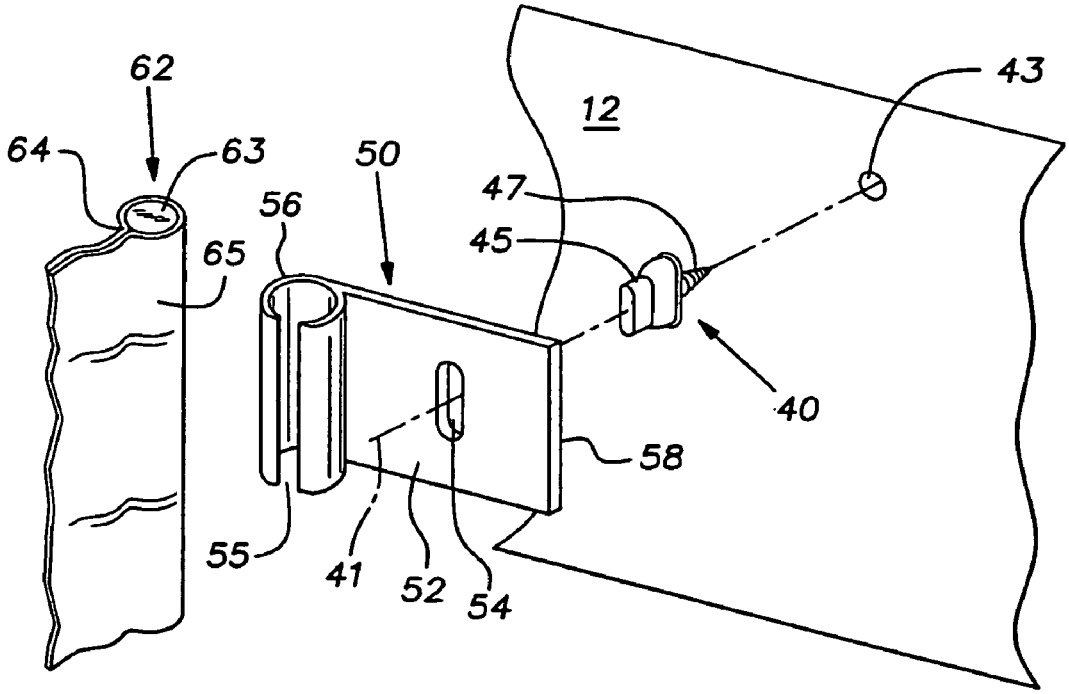
FIG. 2 is an exploded view of a portion of the side wall attachment apparatus according to the present invention with the locking member in a first position.

The channel portion 56 of one embodiment of the channel clip 50 has a cross section that is generally C-shaped as seen in FIG. 2. A restricted opening 55 is disposed in the channel portion 56 such that the restricted opening 55 is opposite the point of connection of the channel portion 56 with the flat portion 52. Alternative embodiments of the present invention include a channel portion 56 having a restricted opening 55 disposed at an angle between 0° and 180° from the point of connection with the flat portion 52.

Any suitably durable material such as plastic, metal, wood, or rubber, for example, may be used to construct the channel clip 50. However, the material is preferably also weather resistant and capable of providing a restricted opening 55 for repeated engagement of the channel clip 50 by a welt 62, described in detail below, without significantly affecting the elasticity of the restricted opening 55 of the channel portion 56. Further, the channel clip 50 may be constructed in a piecewise manner, or fabricated as a one piece molded unit, for example.

Another embodiment of the channel clip 50 includes a protective material 58 provided on a back surface of the flat portion 52. When the screen room enclosure 10 is erected adjacent to the RV 20, the protective material 58 is disposed between the flat portion 52 of the channel clip 50 and the RV 20. The protective material 58 is any suitable material that separates the channel clip 50 from the RV 20, thereby preventing damage to the RV 20 from the channel clip 50.

Yet a further embodiment of the channel clip 50 includes the use of a grommet (not shown) disposed about the inner periphery of the locking hole 54. The grommet reinforces the dimensions of the locking hole 54, thereby reducing the likelihood that the channel clip 50 will tear and release from the wall 12 during use.

The welt 62 is provided on the inner edge 29 of each side panel 26 for communication with the channel portion 56 of the channel clip 50. The welt 62 includes an enlarged portion that extends along the inner edge 29 of the side panels 26. An elastically compressible core 63, for example, can form the enlarged portion according to an embodiment of the present invention. However, other suitable materials can be substituted for the elastically compressible core to form the enlarged portion, thereby forming a welt 62 that is compatible with the channel portion 56 of the channel clip 50. Attaching the welt 62 to the inner edge 29 of the side panels 26 can be accomplished in any way that does not interfere with communication between the welt 62 and the channel clip 50 when the screen room enclosure 10 is erected. For example, the welt 62 can be stitched to the inner edge 29, integrally formed on the inner edge 29, adhesively secured to the inner edge 29, or enclosed within a sleeve 65 (FIGS. 2–4) formed at the inner edge of the side panel. When installation of the side panels 26 is desired, the channel clip engages the welt in a releasable fashion. Formation of the sleeve 65 can be accomplished, for example, by wrapping a portion of the inner edge 29 of each side panel 26 around the core 63 and fastening adjacent surfaces of the inner edge portion to each other as at 64 with an adhesive. The adhesive contemplated by the present invention may be any suitable adhesive and may be sensitive to pressure or heat, or a combination thereof. Alternatively, the adhesive may be applied to fasten the inner edge 29 of the side panel 26 directly to the core 63.

According to another embodiment of the present invention, the sleeve 65 is formed along the inner edge 29 of the side panels 26 by wrapping a portion of the inner edge of each side panel 26 around the core 63 and sewing or stitching the adjacent surfaces of the side panels 26 together with a suitable stitching material 67 as at 68 shown in FIG. 4.

A method for securing the screen room enclosure 10 to the RV generally comprises the steps of installing the locking fasteners 40 at the wall 12, and coupling the side panels 26 to the locking fasteners 40. The communication between the locking fasteners 40 and the side panels 26 provides a secure attachment of the screen room enclosure 10 to the RV 20.

According to a method for installing the side panels 26 of the screen room enclosure 10 to the RV 20, the locking fasteners 40 are installed at the wall 12. Installation of the locking fasteners 40 includes drilling a single hole 43 for receiving the leading edge of each locking fastener 40 at appropriate locations on the wall 12. A single hole 43 for receiving the locking fasteners 40 reduces the number of permanent alterations to the wall 12 required for installation without sacrificing the strength of the screen room enclosure 10 attachment. Due to the adaptable nature of the present method of securing the side panels 26 to the wall 12, the locations of the holes 43 can be selected to avoid windows, wheel wells, doors, and other features located on the wall 12 where installation may be desired. Once drilled, the holes 43 are filled with a liquid sealant that forms an internal barrier (not shown) to minimize the passage of moisture, air, pests and heat through the holes 43 around the locking fasteners 40 after they are installed. Then, the threaded leading edge of each fastening member 47 is inserted into the holes 43 such that the threading of the leading edge engages the inner periphery of the holes 43. Screwing the locking fasteners 40 into place holds them securely at the surface of the wall 12.

Following installation of the locking fasteners 40, the channel clips 50 must be removably fastened to the welt 62 of the side panels 26 to provide communication between the side panels 26 and the locking fasteners 40. This is accomplished by inserting an end of the welt 62 into an open side of the channel portion 56 of the channel clips 50 and sliding the channel clips 50 into position along the length of the welt 62. The position of the channel clips 50 on the welt 62 is slidably adjusted so that the position of the channel clips 50 generally correspond to the position of the locking fasteners 40 on the side wall 12. Thus, when the inner edge 29 of the side panels 26 are placed adjacent the side wall 12, the locking hole 54 is generally concentric with the fastening member 47 along the central axis 41.

According to another method of attaching the channel clips 50 to the welt 62, a compressive force is applied on the welt 62 by the installer. The welt 62 is compressed so that it will pass through the restricted opening 55 and into the channel portion 56. Upon the release of the compressive force, the welt 62 will elastically return to its uncompressed shape and will expand to occupy a majority of an interior of the channel portion 56, effectively holding the side panels 26 in the channel portion 56. Then, the position of the channel clips 50 is slidably adjusted along the length of the welt 62 as described above to generally correspond to the location of the locking fasteners 40 installed on the side wall 12.

After adjusting the position of the channel clips along the welt 62, the locking holes 54 are placed over the locking members 45 while the locking members 45 are in the first position. With the locking holes 54 placed over the locking members 45, the locking members 45 are adjusted to the second position, so that the locking members 45 provide a locking force on the channel clips 50 and secure the side panels 26 to the side wall 12. Thus, a snug seal between the wall 12 and the side panels 26 is achieved. A side panel 26 installed on the wall 12 of the RV 20 according to the present invention is illustrated in FIG. 4.

To remove the screen room enclosure 10 from the wall 12, the locking members 45 are returned from the second position to the first position. This, once again, permits the passage of the locking holes 54 over the locking members 45 to release the channel clips from the wall 12. After the side panels 26 are removed from the wall 12, the channel clips 50 are removed from the welt 62. Removal of the channel clips 50 from the welt 62 is accomplished by reversing the steps described above for attaching the channel clips 50 to the welt 62. The channel clips 50 are either slid along the welt 62 and off of an end of the welt 62, or, the channel clips 50 are removed by compressing the welt 62 and passing it through the restricted opening 55 of the channel portion 56 in its compressed shape. The locking fasteners 40 remain installed on the side wall 12 for rapidly erecting the screen room enclosure 10 again.

While the invention has been described herein with reference to installation on a recreational vehicle, it is appreciated that the present invention is equally adapted for installation on other enclosed structures with a generally vertical wall capable of supporting the installed locking fasteners. As will be apparent to those skilled in the art, certain changes and modifications can also be made without departing from the scope of the invention as defined by the following claims.

What is claimed is:

1. A fastening assembly to releasably secure a panel to a structure, the fastening assembly comprising:

a clip having a channel portion fastened to a flat portion, the channel portion having an opening adapted to receive an edge of a panel, and the flat portion having a hole; and a locking fastener having an elongated locking member adjustable between a first position and a second position, wherein the locking member can pass through the hole when the locking member is in the first position, and cannot pass through the hole when the locking member is in the second position.

2. The fastening assembly according to claim 1 further comprising a threaded portion disposed adjacent to an end of the locking fastener, the threaded portion to engage an inner periphery of a hole formed in the structure and to secure the locking fastener to the structure.

3. The fastening assembly according to claim 1, wherein the channel portion comprises a C-shaped cross-section capable of releasably receiving a welt.

4. The fastening assembly according to claim 1, wherein the channel portion is connected to the flat portion such that the opening is directed outwardly from a point of connection of the channel portion with the flat portion.

5. The fastening assembly according to claim 1, wherein the channel portion is disposed adjacent to a first end of the flat portion and the hole is disposed adjacent to a second end of the flat portion, the second end being opposite the first end.

6. A screen room enclosure to be used with an awning of a structure, the awning being coupled to a wall of the structure, the screen room enclosure comprising:

a locking fastener for installation at the wall of the structure;

a side panel having a first edge to be located adjacent to the structure when the screen room enclosure is erected; and a clip to couple the side panel to the locking fastener, the clip being slidable along the first edge relative to the side panel.

7. The screen room enclosure according to claim 6 further comprising an outer wall capable of being removably fastened at an upper edge to the awning.

8. The screen room enclosure according to claim 7, wherein the outer wall is removably fastenable at a first side edge to a second edge of the side panel.

9. The screen room enclosure according to claim 6, wherein the clip comprises a channel portion secured to a flat portion such that an opening in the channel portion is directed outwardly from a point of connection of the channel portion and the flat portion.

10. The screen room enclosure according to claim 6, wherein the locking fastener comprises a threaded portion disposed at an end of a fastening member, the threaded portion to engage an inner periphery of a hole formed in the structure to secure the locking fastener to the structure.

11. The screen room enclosure according to claim 6, wherein said locking fastener comprises a locking member being rotatably adjustable between a first position and a second position.

12. The screen room enclosure according to claim 11, wherein the locking member adjusted to the first position can pass through a hole disposed in the clip, and the locking member adjusted to the second position cannot pass through the hole disposed in the clip.

13. The screen room enclosure according to claim 11, wherein the clip is a C-channel clip comprising a planar section having a hole engageable with the locking fastener, wherein the hole is adapted to allow the locking fastener to pass therethrough when the locking fastener is in the first position and to not allow the locking fastener to pass therethrough when the locking fastener is in the second position.

14. The screen room enclosure according to claim 6 further comprising a welt extending along the first edge of the side panel.

15. The screen room enclosure according to claim 14, wherein the welt comprises a compressible core disposed within a sleeve formed along the first edge of the side panel.

16. A method of securing a side panel of a screen room enclosure to a structure, wherein the side panel comprises a first edge, the method comprising the steps of:

installing a locking fastener at a location on a wall of the structure, the location being free of obstructions;

attaching a clip to the first edge and moving the clip relative to the first edge such that the location of the clip on the first edge generally corresponds to the location of the installed locking fastener on the structure; and coupling the first edge to the structure by securing the clip to the structure with the locking fastener.

17. The method according to claim 16, wherein the step of installing the locking fastener comprises the steps of:

determining a location on the wall of the structure for installation of the locking fastener, the location being any location on the wall that is free of obstructions;

forming a hole in the wall at the location; and inserting a threaded portion of the locking fastener such that the threaded portion engages an inner periphery of the hole.

18. The method according to claim 16, wherein the step of attaching a clip to the first edge and moving the clip relative to the first edge comprises the steps of:

coupling the clip to a welt disposed along the first edge; and slidably adjusting the position of the clip relative to the welt such that the position of the clip generally corresponds with the location of the locking fastener on the structure.

19. The method according to claim 18, wherein the step of coupling the clip to the welt comprises the steps of:

applying a compressive force on the welt at a location where engagement of the welt by the clip is desired, wherein the location on the welt is compressed by the compressive force;

passing the compressed location on the welt through an opening in a channel portion of the clip; and releasing the compressive force on the location on the welt, allowing the location on the welt to return to its uncompressed form, thereby occupying a majority of an interior of the channel portion.

20. The method according to claim 18, wherein the step of coupling the clip to the welt comprises:

inserting an end of the welt into an open end of a channel portion of the clip; and sliding the clip along a length of the welt until the clip reaches a desired location on the welt.

21. The method according to claim 16, wherein the step of coupling the first edge to the structure by securing the clip to the structure with the locking fastener comprises the steps of:

placing the clip adjacent to the wall of the structure such that a hole in a flat portion of the clip passes over a locking member in a first position; and adjusting the position of the locking member to a second position, thereby preventing removal of the clip from the structure.

* * * * *